US008012893B1

(12) United States Patent
Liebe

(10) Patent No.: US 8,012,893 B1
(45) Date of Patent: Sep. 6, 2011

(54) STRETCHABLE APPLIQUÉ

(75) Inventor: William P. Liebe, Chesterfield, MO (US)

(73) Assignee: R.J. Liebe Athletic Lettering Company, Chesterfield, MO (US)

( * ) Notice: Subject to any disclaimer, the term of this patent is extended or adjusted under 35 U.S.C. 154(b) by 0 days.

(21) Appl. No.: 10/921,612

(22) Filed: Aug. 19, 2004

(51) Int. Cl.
*D03D 15/00* (2006.01)
*B32B 21/10* (2006.01)

(52) U.S. Cl. ..... 442/208; 442/299; 442/199; 428/317.3

(58) Field of Classification Search ..... 442/199, 442/208, 211, 212, 213, 216, 286, 299
See application file for complete search history.

(56) References Cited

U.S. PATENT DOCUMENTS

| | | | | |
|---|---|---|---|---|
| 2,495,847 | A * | 1/1950 | Kerr | 139/421 |
| 5,441,785 | A | 8/1995 | Liebe, Jr. | |
| 5,968,624 | A | 10/1999 | Liebe, Jr. | |
| 5,985,775 | A * | 11/1999 | Deeb et al. | 442/151 |
| 6,659,139 | B2 | 12/2003 | Laycock et al. | |
| 2002/0165477 | A1 * | 11/2002 | Dunshee | 602/58 |
| 2003/0136459 | A1 * | 7/2003 | Laycock et al. | 139/421 |

FOREIGN PATENT DOCUMENTS

JP 03260173 * 3/1990

* cited by examiner

*Primary Examiner* — Lynda Salvatore
(74) *Attorney, Agent, or Firm* — Polster, Lieder, Woodruff & Lucchesi, L.C.

(57) ABSTRACT

An appliqué is described that includes a woven fabric that is stretchable in a single direction.

14 Claims, 1 Drawing Sheet

STRETCHABLE APPLIQUÉ

CROSS-REFERENCE TO RELATED APPLICATIONS

Not applicable.

STATEMENT REGARDING FEDERALLY SPONSORED RESEARCH

Not Applicable.

BACKGROUND OF THE INVENTION

The present invention is directed to types of appliqué for garments and, more specifically to appliqué for garments that is comprised of woven fabric that is stretchable in only a single direction, enabling the appliqué to recover to its original shape; and stretchable and recoverable adhesive for applying the appliqué to a garment and for allowing the appliqué to stretch.

Appliqué are fastened to garments and other larger pieces materials to display fanciful letters, designs, or other decor on the materials. One particular application of appliqués in the form of letters, numbers and fanciful designs, is on athletic uniforms. While the invention is described in particular detail to an athletic uniform use, those skilled in this art will recognize the wider applicability of the invention described hereinafter.

Many athletic uniforms are adapted to be worn tightly, and therefore are designed to be extremely stretchable during the athletic activity, but are also recoverable to ensure a snug fit during normal non active use. For example, football jerseys have progressed from a baggy fit to a fit that is relatively form fitting. Other athletic endeavors have experienced a similar transformation in style. Currently, appliqués that are used on stretchable athletic uniforms are constructed of materials that are stiff and generally inflexible. The constant stretching of these generally inflexible appliqués during wear causes stress about the appliqués, as they are unable to stretch and/or recover simultaneously with the stretchable material upon which they are attached. This results in damage to the appliqués over time in the form of cracking and puckering, making the uniforms undesirable for use in many instances. Also, the inability of prior art appliqués to stretch decreases the functionality of the garment to which they are applied. The stretchable characteristic of the appliqué allows the jersey material to be more form fitting, which allows the jersey to reach the potential for which it was designed.

Therefore, a need exists for an appliqué that can be fastened onto a larger piece of stretchable material like a stretchable athletic uniform, that is adapted to withstand the stress associated with constant stretch and recovery of the material onto which it is attached.

BRIEF SUMMARY OF THE INVENTION

In a first embodiment of the invention a material is provided that comprises a woven fabric that is stretchable in a single direction.

In a second embodiment of the invention, an appliqué is provided that includes a woven fabric that is stretchable in a single direction and has a first and a second side, and a stretchable and recoverable urethane adhesive about the first side of the fabric. The woven fabric comprises twill.

In a third embodiment of the invention, a method for using the above-described appliqué is provided that comprises attaching the appliqué onto stretchable material.

In a fourth embodiment of the invention, a method for using the above-described appliqué is provided that comprises adhering the appliqué to the stretchable fabric using a stretchable and recoverable adhesive and sewing the appliqué onto the stretchable material.

In a fifth embodiment of the invention, a method of making the above-described appliqué is provided that comprises applying the adhesive to at least one side of the woven fabric.

DESCRIPTION OF THE PREFERRED EMBODIMENT

Figure 1:
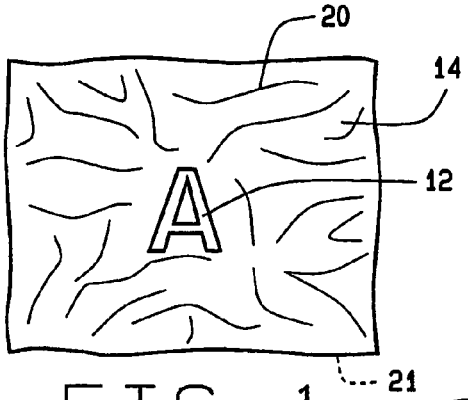
FIG. 1 illustrates one illustrative embodiment of appliqués of the present invention.
Figure 2:
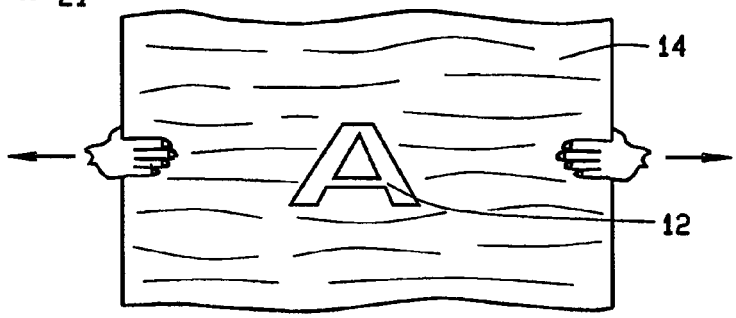
FIG. 2 illustrates the flexible nature in one direction of stretch of the appliqués shown in FIG. 1.
Figure 3:
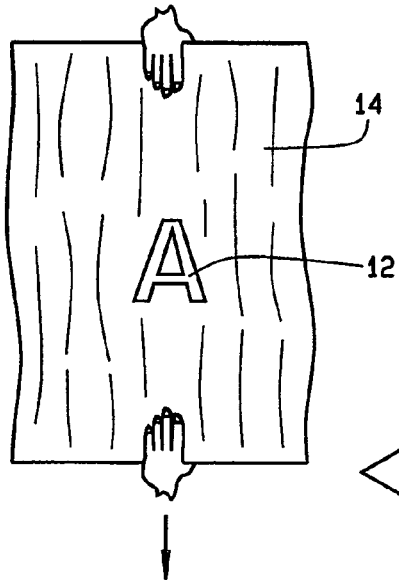
FIG. 3 illustrates the non flexible nature in a second direction of stretch of the appliqués shown in FIG. 1.

A novel and nonobvious material 14 is provided which comprises a woven fabric that is stretchable in a single direction. With reference to FIGS. 2 and 3, the woven fabric is stretchable and recoverable in only one direction. In other words, the fabric is stretchable and recoverable either in a longitudinal or horizontal direction. That is to say, the material 14 is likely to be elongated in a first direction during normal use (FIG. 2), but is unlikely to be elongated in use if a normal force is applied to the appliqué in a second direction (FIG. 3). As will be appreciated by those skilled in the art, "normal" in the context of this application means the force or forces encounter by the appliqué in application use. Although the material 14 may be used in many applications, including making garments, the material 14 is used in one embodiment of the invention to make appliqués 12.

The appliqués 12 of the invention comprise the woven material 14 of the invention. The woven material 14 has a first 20 and a second side 21. In one embodiment of the invention, the appliqués comprise a stretchable and recoverable adhesive about the first side 20, or the second side 21 of the material 14, or both.

The material 14 may be any suitable material that is woven. However, in a particular embodiment of the invention, the fill direction yarn comprises nylon. In yet another embodiment of the invention, the fill direction yarn comprises polyester. As recognized by those skilled in the art, other materials also are available, including for example elastomeric yarn, by way of example and not of limitation, rubber filament, biconstituent filament, and spandex. As will be appreciated by those skilled in the art, elastomeric yarn is a yarn composed of or containing filaments of an elastomer and having the ability to immediately and forcibly return to its original length after repeated stretching to twice of more that twice its original length at room temperature. An elastomer is a synthetic rubbery material, which has the excellent recovery of natural rubber. An elastomer should be capable of repeated stretching to three times its original length: and recovery to its approximate original length upon release of stress. As indicated, Spandex would be considered an elastomeric yarn. Spandex is defined as a generic fiber category that has been defined by the Federal Trade Commission as a "manufactured fiber in which the fiber-forming substance is a long chain synthetic polymer composed of at least 85% of a segmented polyurethane. Spandex can be made as an uncovered filament or can be used in conjunction with other fibers. Most often Spandex is used in conjunction with other filaments where the yarn is covered or core spun. In any case, the finished product is a woven stretchable and recoverable fabric in the weft (fill) direction. The preferred construction is a 3×1 twill. The construction of the current twill comprises 150 D 48 filaments in warp 172 ends per inch. The weft comprises a polyester core wrapped spandex that is 215 D with 78 picks per inch.

Generally, the appliqués of the invention are made by applying an adhesive to at least one side of the woven material 14. Any adhesive may be used in accordance with the invention. However, stretchable and/or recoverable adhesives are generally employed. The use of stretchable adhesives allows the woven material 14 to stretch and recover without hindrance from the adhesive. In a specific embodiment, a urethane adhesive is employed. Those skilled in the art will understand that a polyurethane adhesive such as Dureflex PS3100, offered by Deerfield Urethane works well, for example. This TPU (thermoplastic polyurethane) film is low melting has excellent recovery. Other TPU adhesives are available and may be used, if desired. I also have found that breathable adhesives, i.e., that are breathable themselves or that can be applied in a manner making the combination breathable are desirable in specific embodiments, particularly where the underlying material is breathable. For example, the adhesive can be applied in a dot pattern to allow the fabric to breathe and at the same time allow the material to stretch. In any event, in combination with breathable material a preferred adhesive is a polyester paste that is applied either via a gravure or rotary screen.

The appliqués of the invention are particularly well suited for use on stretchable garments, and stretchable athletic garments in particular. As such, in particular embodiment, the woven material 14 comprises absorbent yarn. One example of a suitable absorbent yarn is Sorbtec™, which is commercially available from ProSham™ of Ontario, Canada.

In one embodiment of the invention, the appliqué 12 of the invention is attached onto a base stretchable fabric 10 using an adhesive. As indicated, the material 14 and the base fabric 10 preferably have similar stretching characteristics. The adhesive may be temperature and/or pressure sensitive in accordance with the invention. In another embodiment, the appliqué 12 of the invention is sewn onto the material. It should be understood that the appliqué 12 may be attached to the material using any known means of attachment thereto.

In a specific embodiment of the invention, the material 14 of the invention comprises a woven fabric that is stretchable in a single direction and has a first and a second side. A stretchable and recoverable adhesive is about one side of the material 14.

In another specific embodiment of the invention, the appliqué 12 comprises a woven fabric, which is stretchable in a single direction and has a first and a second side. A stretchable and recoverable urethane adhesive is about the first side of the fabric.

Figure 4:
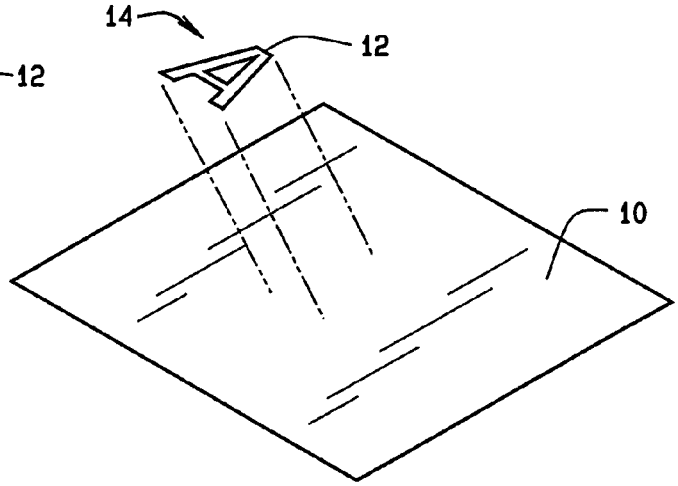
FIG. 4 illustrates the joining of the appliqué of the present invention with a second material.

A method for using the appliqués of the invention is also contemplated to be within the scope of the invention. The method comprises attaching the appliqué onto stretchable base fabric 10, as illustratively shown in FIG. 4. In one embodiment, the material is stretchable clothing, for example, an athletic uniform.

In one embodiment, attaching the appliqué onto stretchable base fabric 10 comprises adhering the appliqué onto the stretchable base fabric 10 using an adhesive. Adhering the appliqué onto the stretchable base fabric 10 allows the appliqué to stay in place while it is being more permanently attached, for example while being sewn to the stretchable base fabric 10. Adhering the appliqué onto the stretchable base fabric 10 also helps to prevent puckering of the appliqué during normal use. Adhering the appliqué to the stretchable base fabric 10 may be accomplished by any known means for accomplishing the same. However, in one embodiment of the invention, adhering the appliqué to the stretchable base fabric 10 comprising applying the adhesive to at least one side of one of the appliqué 12 and/or the fabric 10. The appliqué 12 is then brought into physical contact with the stretchable base fabric 10 upon which it is to be applied. Heat or pressure may be employed to enhance the adherence of the appliqué to the base fabric, if desired.

In one embodiment, the adhesive used is both stretchable and recoverable. Any stretchable adhesive may be used. In one embodiment, the stretchable adhesive is a urethane adhesive.

In another embodiment of the invention, the appliqué 12 is sewn onto the stretchable base fabric 10. The appliqué may be sewn onto the stretchable base fabric 10 after it is adhered to the base fabric with adhesive, or in the absence of being adhered to the base fabric with adhesive.

In view of the above, it will be seen that all the objects and features of the present invention are achieved, and other advantageous results obtained. The description of the invention contained herein is illustrated only, and is not intended in a limiting sense. Numerous variations, with in the scope of the appended claims, will be apparent to those skilled in the art in view of the foregoing description and accompanying drawings. Merely by way of example, the use of the appliqué 12 may extend to applications other than athletic uniforms. Likewise, while certain materials were described as preferred, other materials having similar characteristics as those described maybe utilized. The material forming the appliqué and the material to which the appliqué is applied may have different characteristics. These variations are merely illustrative.

The invention claimed is:

1. A material comprising a woven fabric, the fabric being stretchable in a single direction, that direction being the weft direction of the woven fabric and being non stretchable in the warp direction of the woven fabric in applicational use of the fabric, the material construction enabling the material to recover generally to its original shape after stretch, the material consisting of non elastomeric yarn in the warp direction of the woven fabric and comprising elastomeric yarn in the weft direction of the woven fabric.

2. The material of claim 1 further comprising an adhesive.

3. The material of claim 2 wherein the adhesive is a stretchable adhesive.

4. The material of claim 3 wherein the stretchable adhesive is recoverable to its original shape after stretch.

5. The material of claim 3 wherein the adhesive is a urethane adhesive.

6. The material of claim 1 wherein the woven fabric comprises an absorbent yarn.

7. The material of claim 1 wherein the woven fabric comprises polyester.

8. The material of claim 1 wherein the woven fabric comprises nylon.

9. The material of claim 1 wherein the woven fabric comprises a twill woven material.

10. A material comprising:

a woven fabric having warp and weft directions of weave, the fabric being stretchable in the weft direction of the weave and being non stretchable in the warp direction of the weave in applicational use of the woven fabric, the material formed from elastomeric yarn in the weft direction of weave and consisting of non elastomeric yarn in the warp direction of weave, the material having a first and a second side, and a layer of stretchable adhesive positioned on at least one of the first and second sides of the fabric, wherein the woven fabric comprises twill weave and wherein the material and the adhesive returns to their original shape after a stretching force is applied.

11. A woven fabric having a warp direction and a weft direction comprising:

a plurality of threads of non elastomeric yarn in the warp, the non elastomeric yarn consisting essentially of all the yarn in the warp; and a plurality of threads of elastomeric yarn in the weft, the elastomeric yarn consisting of all the yarn in the weft, the woven fabric being stretchable in the weft direction and being non stretchable in the warp direction in applied use of the fabric, the fabric having uniform single plane surfaces.

12. The woven fabric of claim 11 wherein the non-elastomeric yarn is polyester.

13. The woven fabric of claim 11 wherein the non-elastomeric yarn is nylon.

14. The woven fabric of claim 11 wherein the fabric is selected from the group comprising a twill, a satin, a sateen, a poplin and a plain weave.

* * * * *